US005531387A

United States Patent [19]

Liu

[11] Patent Number: 5,531,387

[45] Date of Patent: Jul. 2, 1996

[54] DEVICE FOR TREATING WASTE FROM WASH BASIN

[76] Inventor: Jehon-Fu Liu, 58, Ma Yuan West St., Taichung, Taiwan

[21] Appl. No.: 381,448

[22] Filed: Jan. 30, 1995

[51] Int. Cl.[6] ..... B02C 23/36

[52] U.S. Cl. ..... 241/46.013; 241/60; 241/79; 241/100; 241/101.2

[58] Field of Search ..... 241/60, 100, 69, 241/46.01, 46.013, 46.014, 46.015, 46.016, 46.017, 46.02, 46.08, 101.2, 79; 34/59

[56] References Cited

U.S. PATENT DOCUMENTS 5,370,323 12/1994 Narao ..... 241/46.017 X

FOREIGN PATENT DOCUMENTS

| | | | |
|---|---|---|---|
| 213361 | 9/1984 | Germany | 241/46.017 |
| 6-099096 | 4/1994 | Japan | 241/46.013 |
| 6-165948 | 6/1994 | Japan | 241/46.013 |

*Primary Examiner*—Mark Rosenbaum

[57] ABSTRACT

A device for treating waste from a wash basin includes a pulverizer for crushing and for grinding waste from the wash basin. A casing includes a mouth connected to the pulverizer for receiving the ground waste and includes a trough for receiving dried waste. A number of blades are rotatably supported in the casing for propelling the waste. A motor is secured to the rotary members for driving the blades to move the waste radially outward in order to dry the waste and so as to propel the waste into the trough for collecting the waste.

4 Claims, 3 Drawing Sheets

DEVICE FOR TREATING WASTE FROM WASH BASIN

BACKGROUND OF THE INVENTION

1. Field of the Invention

The present invention relates to a waste treating device, and more particularly to a device for treating waste from wash basin.

2. Description of the Prior Art

Typical wash basins comprise grate means for preventing large substances from passing into the waste pipe and choking the waste pipe. However, the collected waste are disposed away and may not be treated.

The present invention has arisen to mitigate and obviate the afore-described disadvantages of the conventional wash basins.

SUMMARY OF THE INVENTION

The primary objective of the present invention is to provide a device for treating waste from wash basin so as to form organic fertilizer or manure.

In accordance with one aspect of the invention, there is provided a device for treating waste from a wash basin. The device comprises a pulverizer for crushing and for grinding waste from the wash basin, a housing including an upper portion, a casing secured in the upper portion of the housing and including a mouth connected to the pulverizer for receiving the waste, the casing including a trough formed therein, a screen means disposed in the casing, a large number of rotary members rotatably disposed in the casing and engaged above the screen means, and each includes blade means radially extended outward therefrom for propelling the waste, a large number of frames engaged between the rotary members and secured to the casing, the frames each including a ring formed therein, a large number of boards arranged between and secured to the rotary members so as to be rotated in concert with the rotary members, and means for rotating the rotary members so as to drive the blade means to move the waste radially outward in order to dry the waste and so as to propel the waste into the trough for collecting the waste.

The casing includes a recess formed therein, the frames each includes a panel engaged in the recess so as to be secured to the casing, the frames further include a large number of spacers engaged between the panels for fixing the panels together.

A fan is further secured beside the trough for drying the waste. A container is further arranged below the trough for collecting the waste.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
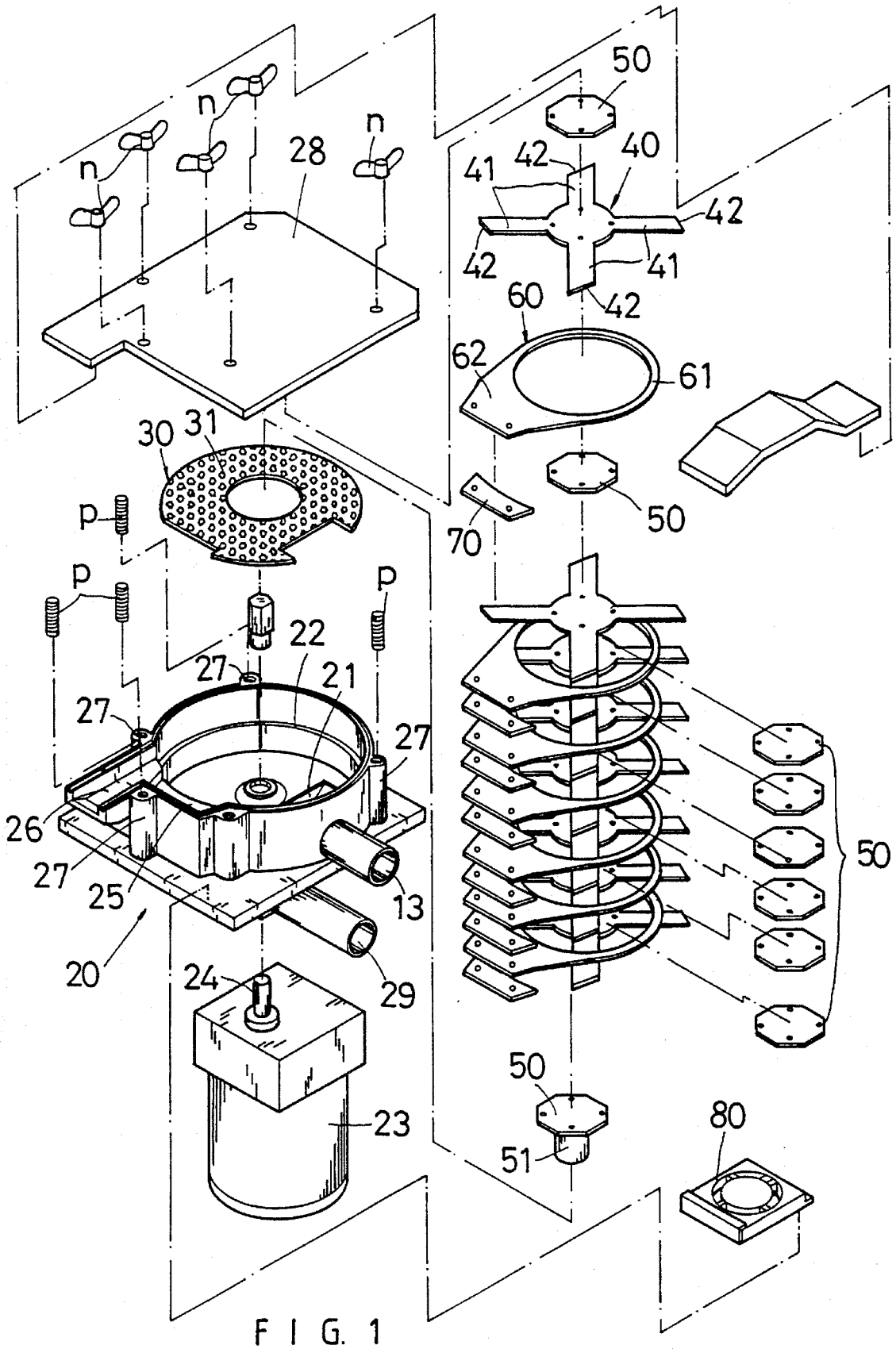
FIG. 1 is an exploded view of a waste treating device in accordance with the present invention.

Referring to the drawings, a waste treating device in accordance with the present invention is coupled to a drain hole 12 of a wash basin 11 or the like and is provided for treating the waste from the wash basin 11. The waste treating device comprises a conventional pulverizer 10 secured to the lower portion of the wash basin 11 and located below the drain hole 12 for collecting and for crushing and grinding the waste. The pulverizer 10 is conventional and commercially available and will not be described in further details.

The waste treating device further comprises a housing 15 including a casing 20 disposed in the upper portion and having a mouth 21 coupled to the pulverizer 10 by a hose 13. The casing 20 includes an annular shoulder 22 formed therein for engaging with and for supporting a screen 30 which includes a number of screen apertures 31 formed therein. A motor 23 is secured to the bottom of the casing 20 and includes a spindle 24 extended upward into the casing 20. The casing 20 includes a recess 25 and a trough 26 formed therein and includes a number of studs 27 formed on the outer peripheral portion for engaging with a number of bolts p and wing nuts n which may secure a plate 28 to top of the casing 20. A drain pipe 29 is coupled to the bottom of the casing 20.

A large number of rotary members 40 are disposed in the casing 20 and arranged above the screen 30 and each includes four blades 41 radially extended outward therefrom. The blades 41 each includes an outward end having a tapered edge 42 formed thereon. A large number of frames 60 are disposed between the rotary members 40 and each includes a ring 61 arranged in concentric with the rotary members 40 and a panel 62 extended into the recess 25 of the casing 20. A large number of boards 50 are arranged in the rings 61 and arranged between the rotary members 40 for spacing the rotary members 40 from each other. The boards 50 are fixed to the rotary members 40 and rotated in concert with the rotary members 40. A large number of spacers 70 are arranged between the panels 62 of the frames 60 and fixed to the frames 60. The lowest board 50 includes a shaft 51 extended downward for fixing to the spindle 24 of the motor 23 such that the blades 41 may be rotated by the motor 23.

Figure 2:
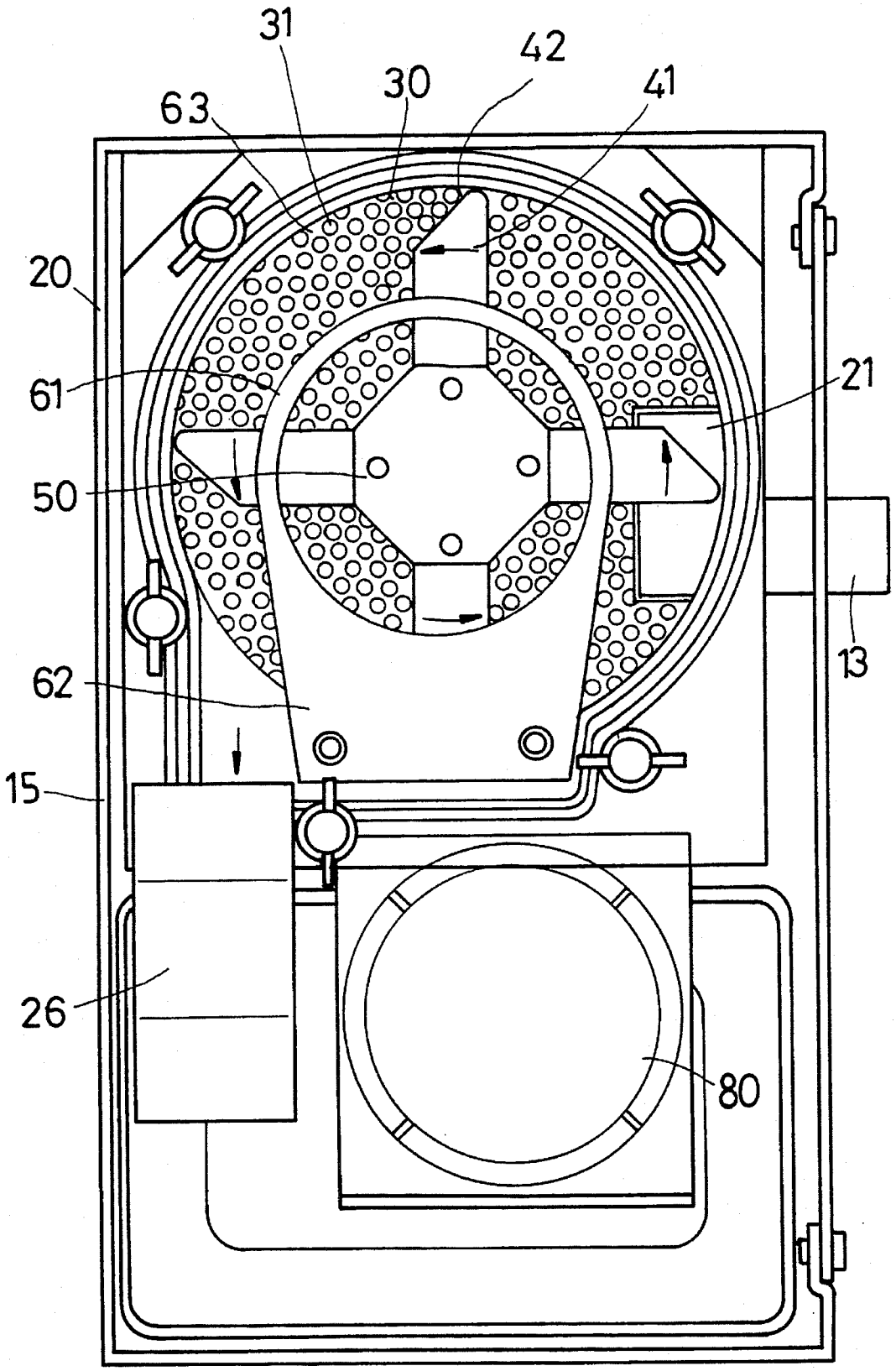
FIG. 2 is a top plane view of the waste treating device.
Figure 3:
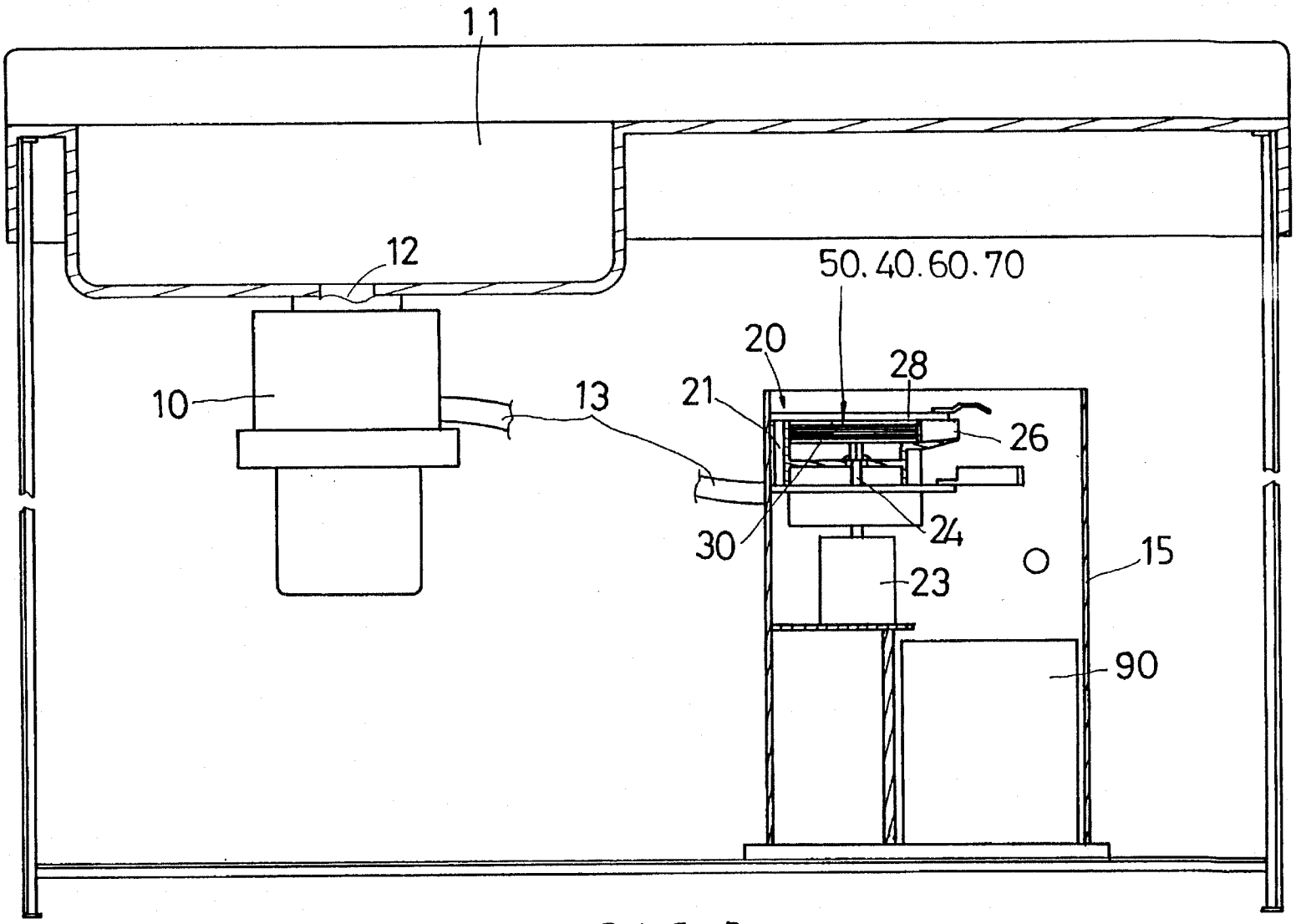
FIG. 3 is a cross sectional view of the waste treating device which is coupled to a wash basin.

As shown in FIG. 2, a C-shaped passage 63 is formed around the frames 60 and communicating with the mouth 21 and the trough 26, such that the waste coming from the hose 13 and entering into the mouth 21 may be stirred and propelled by the blades 41 and such that the waste may be forced to move radially outward toward the inner peripheral surface of the casing 20. The waste may thus be dried and the water may be removed from the waste and flow through the screen 30 and flow out via the drain pipe 29. The dried waste may be gradually forced by the blades 41 to move into the trough 26. A fan 80 is disposed beside the trough 26 for further drying the waste. A container 90 is disposed below the trough 26 for collecting the dried waste falling from the trough 26, and the dried waste may be used as organic fertilizer or manure. A paper bag may further be provided within the container 90 for receiving the dried waste and may include ferment therein for fermenting the waste so as to turn the waste into the organic fertilizer or manure.

Accordingly, the waste treating device in accordance with the present invention may treat waste from wash basin so as to form organic fertilizer or manure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A device for treating waste from a wash basin, said device comprising:

a pulverizer for crushing and for grinding waste from said wash basin, a housing including an upper portion, a casing secured in said upper portion of said housing and including a mouth connected to said pulverizer for receiving said waste, said casing including a trough formed therein, a screen means disposed in said casing, a large number of rotary members rotatably disposed in said casing and engaged above said screen means, and each of said rotary members including a plurality of blades radially extended outward therefrom for propelling said waste, a large number of frames engaged between said rotary members and secured to said casing, each of said frames including a ring formed therein, a large number of boards arranged between and secured to said rotary members so as to be rotated in concert with said rotary members, and means for rotating said rotary members so as to drive said blades to move said waste radially outward in order to dry said waste and so as to propel said waste into said trough for collecting said waste.

2. A waste treating device according to claim 1, wherein said casing includes a recess formed therein, each of said frames includes a panel engaged in said recess so as to be secured to said casing, said frames further include a large number of spacers engaged between said panels for fixing said panels together.

3. A waste treating device according to claim 1 further comprising a fan secured beside said trough for drying said waste.

4. A waste treating device according to claim 1 further comprising a container arranged below said trough for collecting said waste.

* * * * *